US009177424B2

(12) United States Patent
Ortmann et al.

(10) Patent No.: US 9,177,424 B2
(45) Date of Patent: Nov. 3, 2015

(54) FRANKING MACHINE AND METHOD FOR SERVICING THEREOF

(71) Applicants: Axel Ortmann, Berlin (DE); Wolfgang Muhl, Hohen Neuendorf (DE)

(72) Inventors: Axel Ortmann, Berlin (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 76 days.

(21) Appl. No.: 13/917,926

(22) Filed: Jun. 14, 2013

(65) Prior Publication Data

US 2013/0335497 A1 Dec. 19, 2013

(30) Foreign Application Priority Data

Jun. 15, 2012 (DE) ..... 20 2012 005 904

(51) Int. Cl.

| | |
|---|---|
| ***B41J 29/13*** | (2006.01) |
| ***G07B 17/00*** | (2006.01) |
| ***B41J 2/165*** | (2006.01) |
| ***B41J 13/12*** | (2006.01) |

(52) U.S. Cl.

CPC ..... *G07B 17/00* (2013.01); *B41J 2/16508* (2013.01); *B41J 13/12* (2013.01); *G07B 17/00193* (2013.01); *B41J 2/16538* (2013.01); *G07B 2017/00233* (2013.01); *G07B 2017/00532* (2013.01)

(58) Field of Classification Search

CPC ..... G07B 17/00; G07B 17/00193; G07B 2017/00233; G07B 2017/00532; B41J 2/16508; B41J 2/16538; B41J 13/12

USPC ..... 347/108, 109, 22, 49

See application file for complete search history.

(56) References Cited

U.S. PATENT DOCUMENTS

| | | | | |
|---|---|---|---|---|
| 5,526,271 | A | 6/1996 | Abumehdi | |
| 6,209,983 | B1 | 4/2001 | Osborne et al. | |
| 8,262,178 | B2 | 9/2012 | Muhl | |
| 8,708,482 | B2 * | 4/2014 | Yamamoto | 347/108 |
| 2003/0112314 | A1 | 6/2003 | Hetzer et al. | |
| 2003/0112315 | A1 * | 6/2003 | Hetzer et al. | 347/108 |
| 2004/0027444 | A1 | 2/2004 | Silverbrook et al. | |
| 2005/0018009 | A1 | 1/2005 | Otsubo | |
| 2006/0010000 | A1 | 1/2006 | Jauert et al. | |
| 2009/0303284 | A1 | 12/2009 | Muhl et al. | |
| 2012/0120172 | A1 | 5/2012 | Ortmann et al. | |

* cited by examiner

*Primary Examiner* — Henok Legesse
(74) *Attorney, Agent, or Firm* — Schiff Hardin LLP

(57) ABSTRACT

A franking machine has an ink jet printing device with exchangeable ink cartridges. The lower housing shell of a security housing of the franking machine has a sealable, shaft-shaped opening in the base and is designed to accommodate assemblies that can be contaminated with ink. These assemblies are situated in a non-secure region of the franking machine and are accessible via the aforementioned opening when a cover of the shaft-shaped opening is opened. A servicing procedure allows the franking machine to be retrofitted to print with a different ink color. After moving the print carriage in one direction and opening a cartridge flap, the ink cartridges can be removed. A displacement of the print carriage takes place after closing the cartridge flap, wherein the print carriage is moved in the opposite direction so that the print carriage arrives in the sealing position for ink cartridges. A box-shaped mod can now be removed from the franking machine. Servicing of the ink-contaminated modules subsequently takes place via the aforementioned opening.

10 Claims, 9 Drawing Sheets

Detail A

FRANKING MACHINE AND METHOD FOR SERVICING THEREOF

BACKGROUND OF THE INVENTION

1. Field of the Invention

The invention concerns a franking machine of the type having a printing device to print on a flat item (for example a mail piece or a franking tape) with a predetermined franking color. Such franking machine is used in connection with peripheral and other mail processing apparatuses in a franking system that is purchased, or rented wholly or in part, by a customer. The invention also concerns a method for servicing such a franking machine.

2. Description of the Prior Art

The color of the imprint produced by a franking machine is predetermined in a nation-specific manner by respective national postal authorities. Franking machines of various types are known in which a modification is made only if a mail piece is to be sent from one country to another country in which a different color of imprint is mandated. For example, when franking machines have been leased in the one country and are replaced by other franking machines in that country, the franking machines that are no longer leased can be retrofitted, shipped to another country and offered for sale there. In the case of currently available franking systems from Francotyp Postalia GmbH and other companies, a retrofitting of the franking color is possible only after opening the security housing. The parts and/or assemblies contaminated with ink can be cleaned or exchanged after opening the security housing.

High retrofitting and servicing costs are especially disadvantageous in a lease transaction. Moreover, there is no simple servicing of the franking machines.

It has been proposed to allow an operator to implement an exchange of an assembly at an apparatus without having to arrange for, and be charged by, a service technician for this task. For this purpose, a locking device for a tray into which a pluggable assembly is inserted is known from German Utility Patent DE 202010015352 U1. The tray is accessible only when the apparatus is unpowered. A power-free contacting of the assembly is then possible. By contrast, an additional access to a low power connector is only accessible when the first cited access is locked. The operator can advantageously implement an exchange of an assembly after the power cable has been pulled out of the low power connector.

A device to lower, position, and raise contact pressure elements of a printer apparatus is known from the German Utility Patent DE 202010015351 U1. A box-shaped module is described therein that is equipped with a feed table that has at its top side an opening for the contact pressure elements of a contact pressure device, and the contact pressure elements are arranged to be removable to facilitate their servicing. In an operating position, the box-shaped module is arranged below the printing device of the franking machine and can be removed from this position for the purpose of servicing. A mechanical connection element and an ink reservoir are arranged at the back side of the box-shaped module. As soon as an internal lock is released, the box-shaped unit slides forward like a drawer on two guide rails and can be completely removed. After concluding the servicing, it can be brought completely back into the operating position by means of the two guide rails and be used further. For example, the box-shaped module can be removed to correct a jam. However, after a jam it has been shown in practice that the servicing of the contact pressure elements of the box-shaped module and a cleaning of light sensors of the photoelectric barriers of the franking machine takes place much more often than a servicing of the ink reservoir. Moreover, the ink reservoir is contaminated by an ink cloud that permeates the franking machine through all openings that are not completely sealed during the operation of the printing device. Naturally, a cleaning of the surface of the lower housing part of the franking machine that is contaminated by an ink cloud is time-consuming. Such a franking machine thus cannot be resold in another country without further measures.

SUMMARY OF THE INVENTION

An object of the present invention is to remedy the disadvantages of the known devices. A structural design of the ink-contaminated assemblies and their arrangement in the franking machine should allow access to these assemblies and their exchange without opening the security housing. The servicing of the franking machines should additionally be simplified.

Assuming that a security housing encloses the ink printing device and its control unit, and that an opening of the security housing is necessary exclusively when an access to security-relevant modules should be enabled, a secure region is differentiated from a plurality of non-secure regions: all assemblies that can be contaminated with ink are arranged in the non-secure regions of the franking machine. One of the non-secure regions of the franking machine is that region in which the box-shaped module known from DE 202010015351 U1 is brought into the operating position. The front side of the lower housing shell of the franking machine is set back relative to the front side of the upper housing shell and the front side of the lower housing shell whose bases are designed accordingly, such that all assemblies that can be contaminated with ink are not situated in non-secure regions. The box-shaped module is a first unit that can be removed and exchanged. However, no ink reservoir has now been molded on the back side of the box-shaped module. According to the invention, an ink capture container corresponding to the ink reservoir is modularly arranged within the franking machine at a position situated between the cleaning and sealing station and the base plate of the lower housing part. This position is accessible via a shaft-shaped opening in the base of the lower housing shell of the franking machine. The shaft-shaped opening has at least one guide rail and facilitates the installation of the ink capture container. At least one service module is associated with an inkjet print head. The latter can be an integrated component of an ink cartridge. A cleaning and sealing station is formed by two removable and exchangeable service modules, with an inkjet print head of the print carriage being associated with each of the service modules. The shaft opening is designed so that it can be sealed by a cover. Ink particles of the ink cloud become deposited within the ink capture container of the franking machine. The ink capture container is pressed against the two service modules when the cover of the shaft-shaped opening is closed. An unwanted contamination of one of the visible surfaces of the franking machine is therefore avoided.

Opening of the cover in the base of the lower housing shell thus enables an access to an additional non-secure region and an exchange of assemblies without opening the security housing. Access to exchange an ink receptacle is possible after the ink capture container has been removed first, and then the two service modules of the cleaning and sealing station, with the ink receptacle arranged at the print carriage. For a servicing, for example a retrofitting of the franking color, a removal of the ink cartridge and a closing of the cartridge flap initially take place in the operating mode. The franking machine is subsequently deactivated and the connection to mains power is interrupted by removing the plug connector of the power cable from the low power connection, and access to the latter is sealed by a slider. By turning a tool, for example a screwdriver, preferably a multifunction stylus equipped with a screwdriver bit, rotation of the shaft inside the franking machine can be produced even without an electric actuator, such that the print carriage moves until it arrives at the sealing position for ink cartridges in which a removal of the box-shaped module is enabled. Implementation of servicing of ink-contaminated assemblies that are arranged in the box-shaped module, and those that are arranged in the base of the lower housing shell of the franking machine, subsequently takes place.

When the franking machine is not connected to mains power, manual displacement of the print carriage can move it into a position in which the cartridge flap opens. For this purpose, the franking machine is equipped with a hole in the security housing into which the multifunction stylus is introduced and turned. The ink cartridges can thus be exchanged at arbitrary points in time, even when no removal of the ink cartridges by the customer has previously taken place. The cartridge flap is subsequently closed again.

The print carriage is mounted so as to be mechanically movable within the franking machine on a slide rail to direct the print carriage along a designed path. The print carriage can likewise be moved in the opposite direction by an adjustment by means of the multifunction stylus, such that the print carriage arrives in the sealing position for ink cartridges. This allows the removal of the box-shaped module from the franking machine for the purpose of cleaning the sensors and transport elements of the franking machine as well as for the exchange of the contact pressure elements that are arranged in the box-shaped module so as to be exchangeable. In the event of a more serious contamination, the entire box-shaped module can be exchanged. After removal of the box-shaped module, the franking machine can be rotated so that the base of the lower housing shell faces upwardly. The cover can now be uninstalled from the base of the lower housing shell in order to enable access via the shaft-shaped opening to the additional non-secure region of the franking machine. After removing the ink capture container, the service modules, and an ink receptacle that includes a wiping lip cleaning sponge, all assemblies that are required to retrofit the franking color can be reinstalled in the reverse order. The print carriage has an ink receptacle cavity so that a new, clean ink receptacle can be installed in the ink receptacle cavity. The service modules and the ink capture container are subsequently renewed. The franking machine can be activated again after sealing the shaft-shaped opening with the cover and establishing a power connection. The print carriage can be moved with the electric actuator. This enables the cartridge flap to be opened. The ink cartridges with the new franking color are now to be used in the franking machine, and the retrofitting of the franking machine is ended.

DESCRIPTION OF THE PREFERRED EMBODIMENTS

Figure 1:
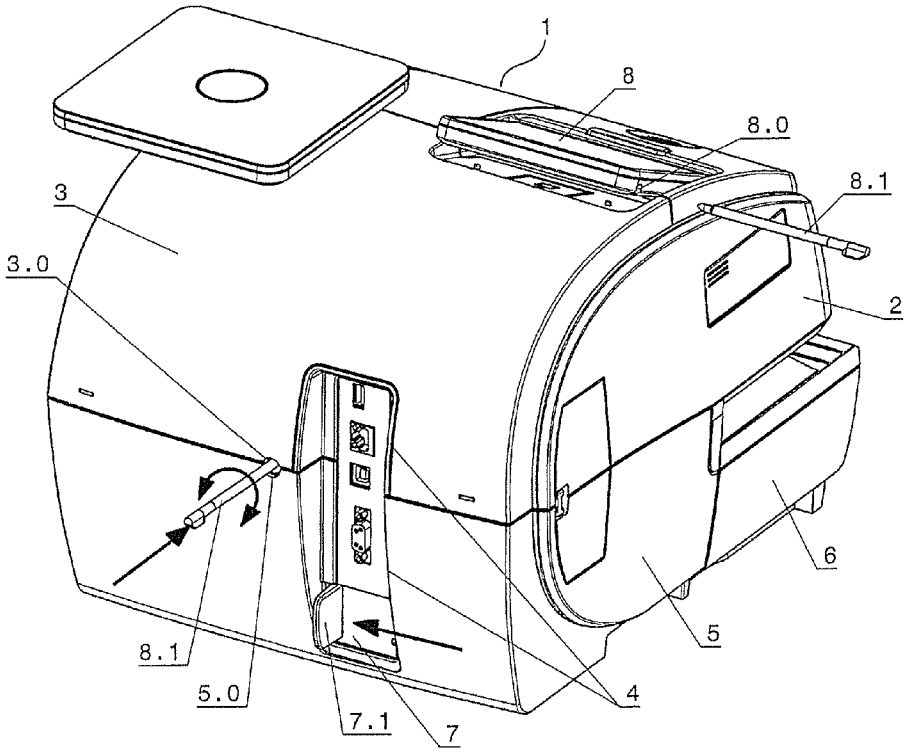
FIG. 1 is a perspective view of a franking machine in accordance with the invention, as seen from the upper rear right, with the mains power connection blocked by a slider and with a stylus inserted therein, that is also separately shown, with a portion thereof separately shown enlarged in Detail A.
Figure 1:
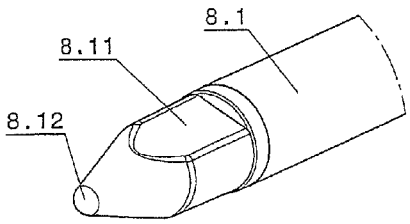
Figure 1:
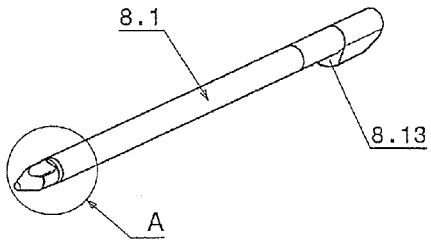

FIG. 1 is a perspective view of a franking machine from the rear upper right, with the mains power connector blocked by a slider. FIG. 1 also includes Detail A. The assemblies of the franking machine 1 are surrounded by an upper housing shell 2 and a lower housing shell 5 that, together with a plate 3 at the upper housing shell 2, form a security housing. A box-shaped module 6 can be removed from the franking machine 1. The back side of the franking machine 1 has a depression 4 up to a metal plate, with sockets for the electrical connections. Access to one of the electrical connections results in a low power connection. The aforementioned access can be sealed by a slider 7 when the latter is shifted in the arrow direction. A slider handle 7.1 is molded on the slider 7 for operation thereof. The aforementioned depression 4 is partially molded into the upper housing shell 2 and into the lower housing shell 5. The edge of the plate 3 meets the edge of the lower housing shell 5 at the back side of the franking machine. In the middle of the housing, a hole is formed by one semicircle-shaped opening 3.0 at the edge of the upper housing shell 2 and another semicircle-shaped opening 5.0 at the edge of the lower housing shell 5. The hole is provided for insertion of a multifunction stylus 8.1, which then serves as a rotation tool. A display 8 is provided at the top side of the franking machine 1. The latter has a mount 8.0 for the multifunction stylus 8.1. The multifunction stylus 8.1 can be removed from the franking machine 1 due to a projection 8.13 at the one end of the stylus 8.1 so that the stylus 8.1 can then be used to make inputs via a touchscreen of the display. The stylus 8.1 is used to displace components in the franking machine 1 by rotation of multifunction stylus 8.1 after being introduced into the hole. The stylus tip 8.12 of the multifunction stylus 8.1 is shaped in order to make the aforementioned touchscreen inputs, as shown in Detail A. A tool in the form of a socket key is shaped between the shaft of the stylus 8.1 and the tip 8.12 of the stylus. In the shown example, the tool has a cylindrical shank with a flat area.

Alternatively, a hex head or another shape can be used.

Figure 2:
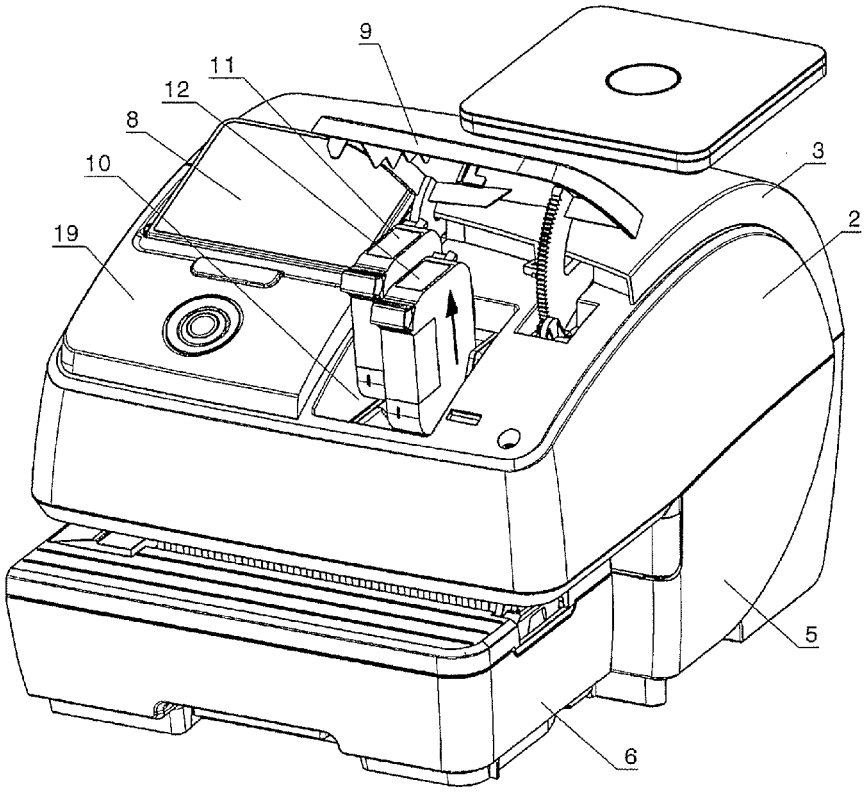
FIG. 2 is a perspective view of the franking machine from the upper front right, with a box-shaped module and an open cartridge flap.

A perspective view of the franking machine from the upper front right according to FIG. 2 shows an open cartridge flap 9 at a surface of the plate 3 that is angled forward. The open cartridge flap 9 uncovers an access to a shaft 10 order to be able to exchange ink cartridges 11, 12. The cartridge flap 9 approximately occupies the left half of the top side of the franking machine, while the display 8 is arranged in a plate 19 which occupies the other half of the top side of the franking machine and is installed on the upper housing shell 2. A box-shaped module 6 is positioned at the front of the franking machine, below the upper housing shell 2, and forms a drawer-like, modular part that can be removed at the front.

Figure 3:
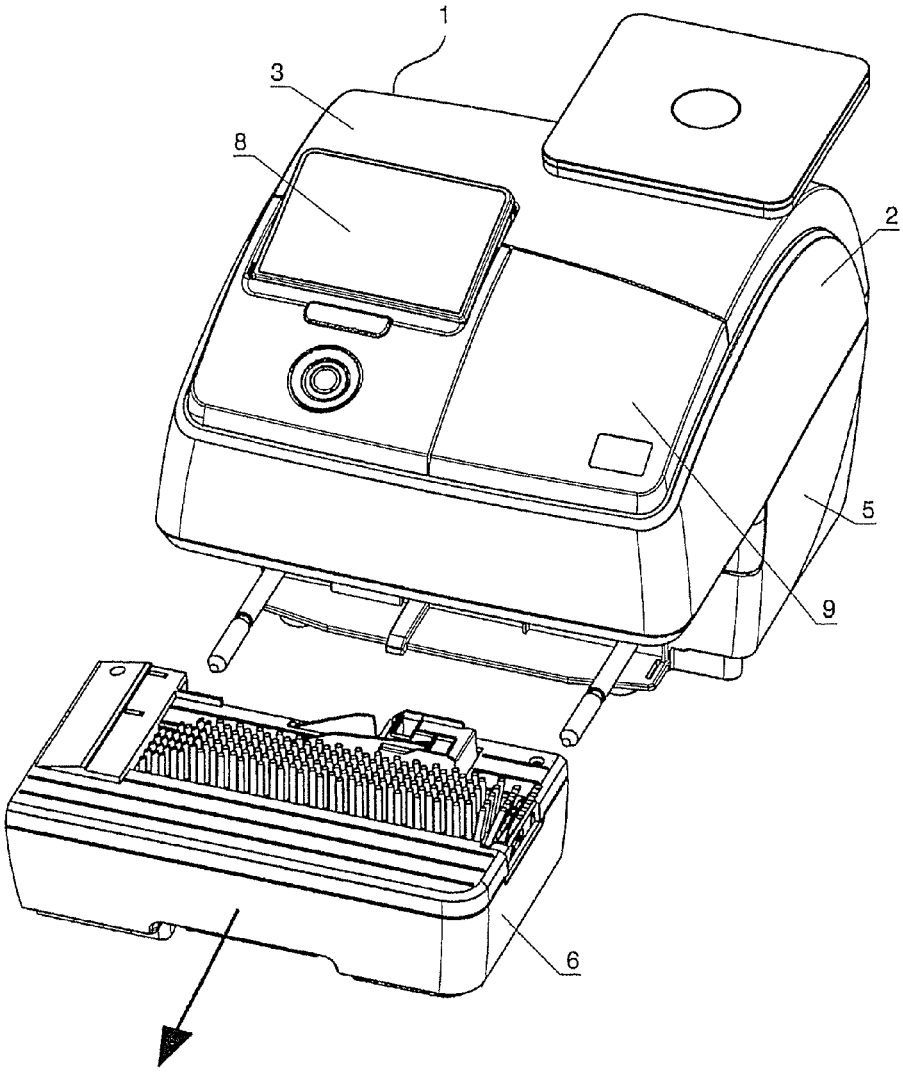
FIG. 3 is a perspective view of the franking machine from the upper front right, with a box-shaped module pulled forward.

FIG. 3 is a perspective view of the franking machine 1 from the top upper right, with a box-shaped module 6 removed at the front. The angled-forward surface of the plate 3 transitions into a closed cartridge flap 9 that extends to an upper forward edge of the upper housing shell 2 of the franking machine 1.

Figure 4:
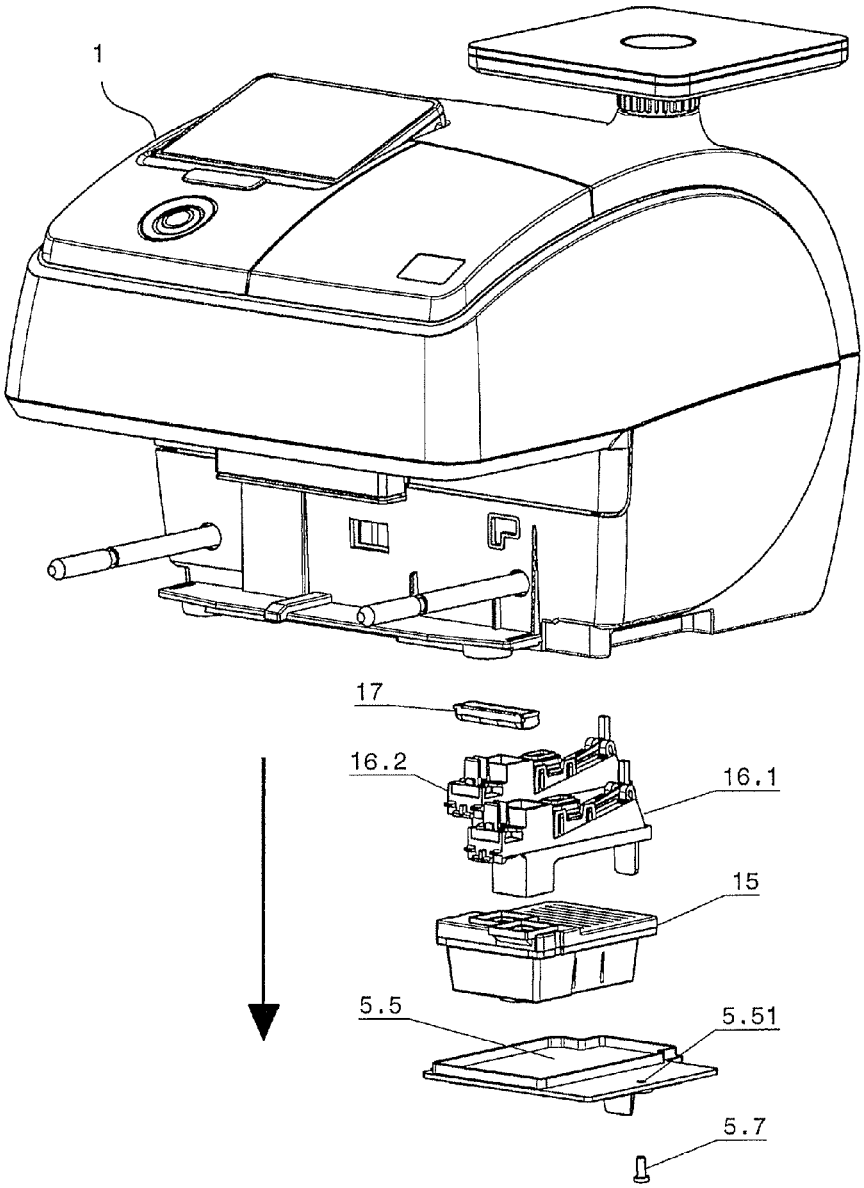
FIG. 4 is a perspective view of the franking machine from the upper front right, with multiple module-shaped modules shown pulled downward.

FIG. 4 is a perspective view of the franking machine 1 from the upper right front, with multiple module-like structural units 15, 16.1, 16.2 and 17 shown removed at the rear, which modules are arranged under a cover 5.5 inside the franking machine 1. The cover 5.5 has a screw opening 5.51 and can be attached to the base of the franking machine 1 by means of a screw 5.7 so as to be detachable. The removed box-shaped module is not shown, for better clarity.

Figure 5:
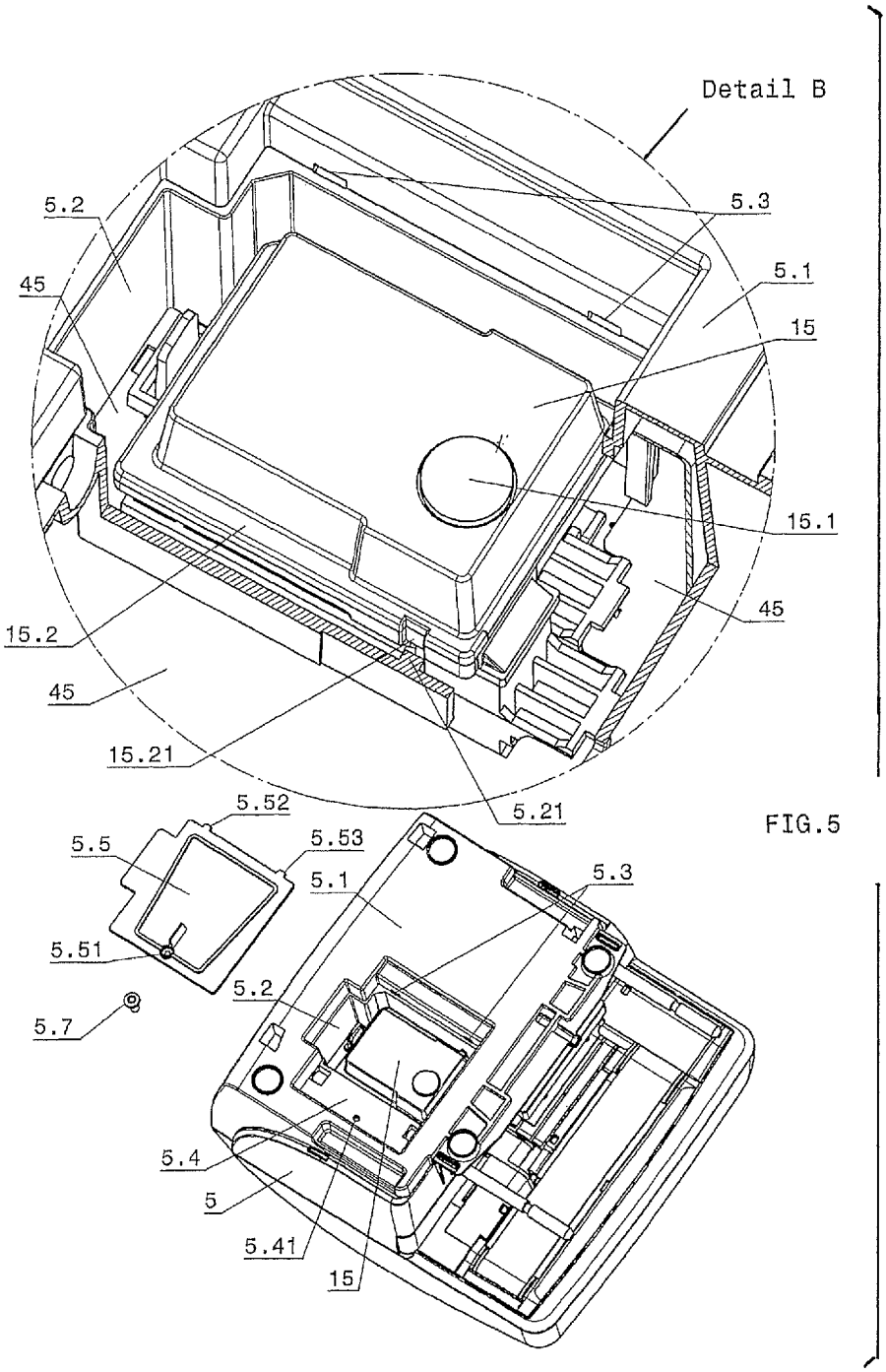
FIG. 5 is a perspective view of the franking machine from below, with a shaft-shaped opening and with an uninstalled cover, and with an installed ink capture container separately shown in Detail B.

FIG. 5 is a perspective view of the franking machine 1 from below, so that a shaft-shaped opening 5.2 and with an uninstalled cover 5.5 can be seen, as well as an installed ink capture container 15, the arrangement of which is explained in detail using Detail B. At the base 5.1 of the lower housing shell 5 is a shaft-shaped opening 5.2, via which a number of module-shaped structural units can be uninstalled and installed when the screw 5.7 is loosened by being unscrewed from a bolt hole 5.31 in a bearing surface 5.4, and the cover 5.5 has been removed. The cover 5.5 has two installation projections 5.52, 5.53 that are arranged on the edge of the cover opposite the bolt opening 5.31. The shaft-shaped opening 5.2 is equipped with two suitably shaped, slot-shaped openings 5.3 on the side, into which the installation projections are plugged upon installation of the cover 5.5. The bearing surface 5.4 lies in a recess of the base 5.1 opposite the side with the slot-shaped openings 5.3 and transitions into a ledge in the shaft-shaped opening 5.2. The shaft-shaped opening 5.2 extends to a frame base plate 45 which has a narrower opening with a predefined contour in the region of the shaft-shaped opening 5.2. The shaft edge near the bearing surface has been depicted in section in Detail B in order to make a guide rail 5.21 at the shaft edge visible, in which guide rail 5.21 a guide groove 15.21 engages which has been shaped at an edge 15.2 of the installed ink capture container 15. A rubber-like, elastically deformable disc 15.1 is attached to the ink capture container 15, near the guide groove. Given an installed cover 5.5, an inserted ink capture container 15 is exposed by the disc 15.1 to a contact pressure which presses the ink capture container 15 against the underlying free-spraying shafts of the service modules. The contour of the opening in the frame base plate 45 is adapted to the shape of the service modules, which are subsequently explained using FIG. 6.

Figure 6:
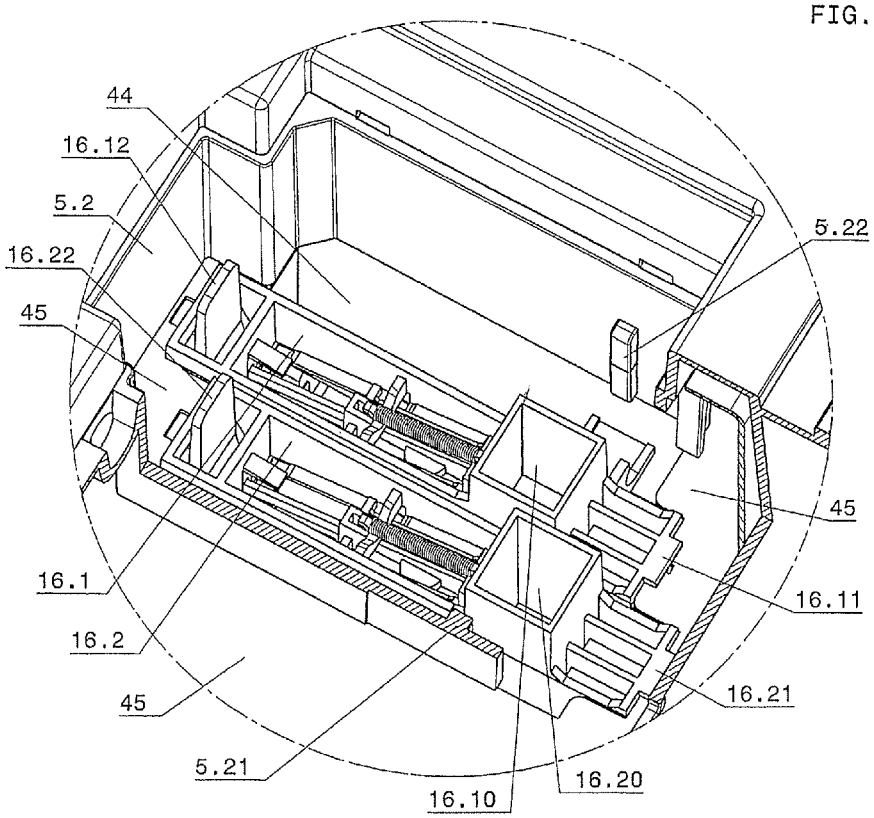
FIG. 6 is a perspective view of the shaft-shaped opening with two service modules in the same environment as Detail B.

FIG. 6 is a perspective view of the shaft-shaped opening 5.2 with two service modules 16.1 and 16.2 that are installed offset from one another at a contour of the frame base plate 45. Both service modules 16.1 and 16.2 have the same box-like shape. With attachment means, they are respectively equipped at the ends with a frame and with a free-spraying shaft, the last two being arranged in succession. At least one installation projection 16.11, 16.21 as an attachment means is arranged at the one end of the series arrangement, and a respective, resiliently elastic detent lever 16.12, 16.22 as an attachment means is arranged at the other end of the series arrangement. The series arrangement respectively has a free-spraying shaft 16.10, 16.20 with a quadratic cross section area which transitions into a shaped part at which the at least one installation projection 16.11, 16.21 is molded. At the opposite side, the series arrangement respectively has a frame with a rectangular cross section area which is oblong in shape and at which is molded a resilient elastic detent lever. A guide rail 5.21 is shown in section at a shaft wall of the shaft-shaped opening in the base of the lower housing shell. An additional guide rail 5.22 that is arranged at the shaft wall, near a frame side wall 44, exists opposite this guide rail 5.21. The frame side wall 44 and the frame base plate 45 are firmly connected with one another. The guide rails 5.21, 5.22 cooperate with the guide grooves 15.21, 15.22 arranged at the edge 15.2 of the ink capture container 15 upon installation.

Figure 7:
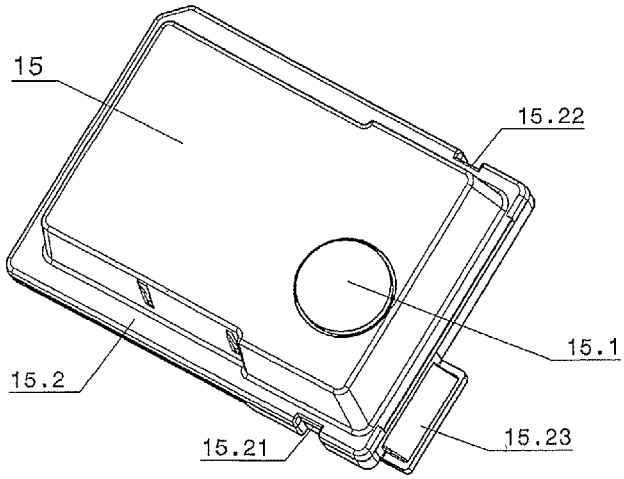
FIG. 7 is a perspective view of the uninstalled ink capture container.

The guide grooves arise from the perspective presentation of the uninstalled ink capture container 15 that is shown in FIG. 7. Molded opposite the disc 15.1, at a corner of the edge 15.2, is a funnel 15.23 near the guide groove 15.21, wherein the edge of the funnel is arranged parallel to the disc surface and—upon installation—rests on the edge of the free-spraying shaft 16.20 so as to seal it, and conducts the free-spraying ink into the ink capture container 15.

Figure 8:
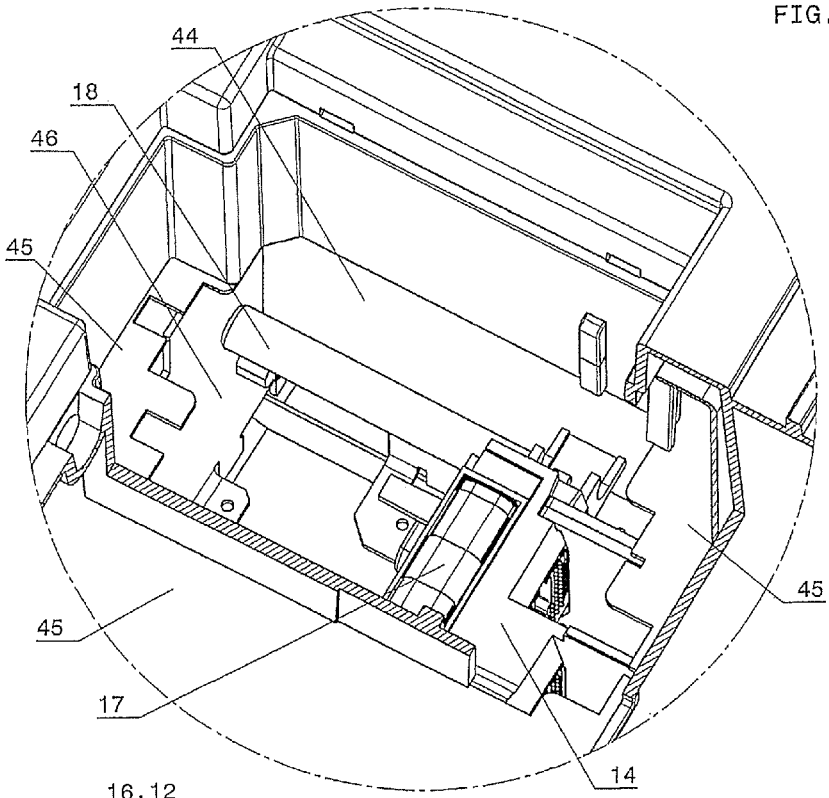
FIG. 8 is a perspective view of the shaft-shaped opening with an ink receptacle installed at the print carriage, in the same environment as Detail B.

Using the perspective presentation of the shaft-shaped opening shown in FIG. 8, with an ink receptacle 17 installed at the print carriage 14, which contains an ink jet module and controls therefor. The contour of the opening in the frame base plate 45 is also visible since the service modules (RDS modules) have been uninstalled. The contour is adapted to the shape of the service modules. The offset in the contour corresponds to the offset of the position of the ink cartridges in the print carriage 14. A slide rail 18 to guide the print carriage extends parallel to the frame side wall 44 and is attached to a rear frame wall 46. The ink receptacle is designed so as to be installable in order to be installed in an ink receptacle cavity which is incorporated into the print carriage, which arises from FIG. 10. The print carriage is arranged in the franking machine so as to be mechanically movable on the slide rail 18, which arises from FIGS. 8, 10 and 12. The ink receptacle 17 is exchangeable when the print carriage 14 arrives in a non-secure region, which is accessible via the shaft-shaped opening.

Figure 9:
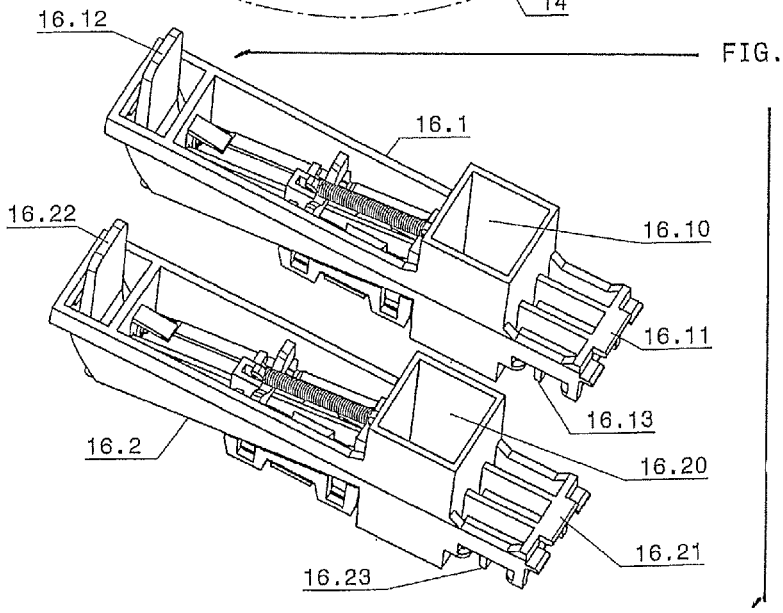
FIG. 9 is a perspective view of the two uninstalled service modules.

A perspective view of the two uninstalled service modules is shown in FIG. 9. Each of the service modules 16.1 and 16.2 has at the respective end a shaped part with an installation projection 16.11, 16.21 that extends in the direction of the edge of the contour. Wiping lips 16.13, 16.23 are attached at each shaped part, each wiping lip 16.13, 16.23 extending in the direction of the print carriage when the service module is installed at the frame base plate 45. At the opposite end of each service module 16.1, 16.2 is a respective molded resilient elastic detent lever 16.12, 16.22. Each detent lever 16.12, 16.22 extends opposite the direction (thus away from the print carriage) when the service module is installed at the frame base plate 45. Each service module 16.1 and 16.2 has a respective free-spraying shaft 16.10, 16.20 therein.

Figure 10:
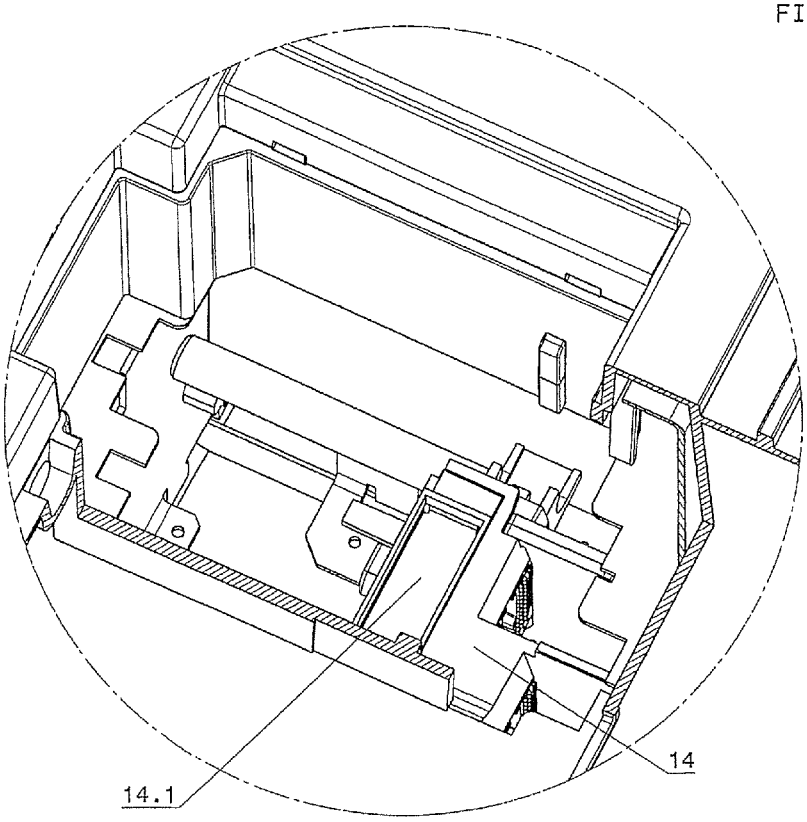
FIG. 10 is a perspective view of the shaft-shaped opening, without the ink receptacle, in the same environment as Detail B.

FIG. 10 is a perspective view of the shaft-shaped opening with the print carriage 14 without an ink receptacle, but with an ink receptacle cavity 14.1.

Figure 11:
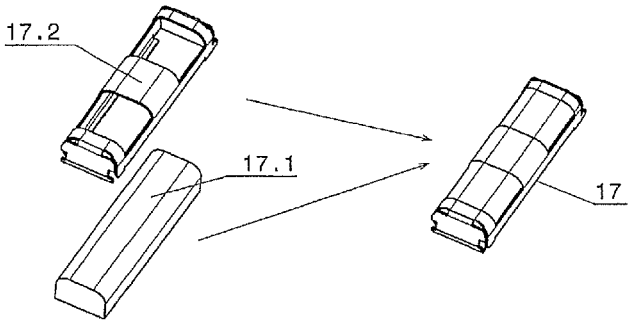
FIG. 11 is a perspective view of the ink receptacle.

The perspective view of the ink receptacle 17 is shown in FIG. 11. For example, the ink receptacle has a sponge 17.1 and a sponge mount 17.2 that can be inserted into the ink receptacle cavity 14.1. The sponge mount 17.2 is equipped with a snap-in connection.

Figure 12:
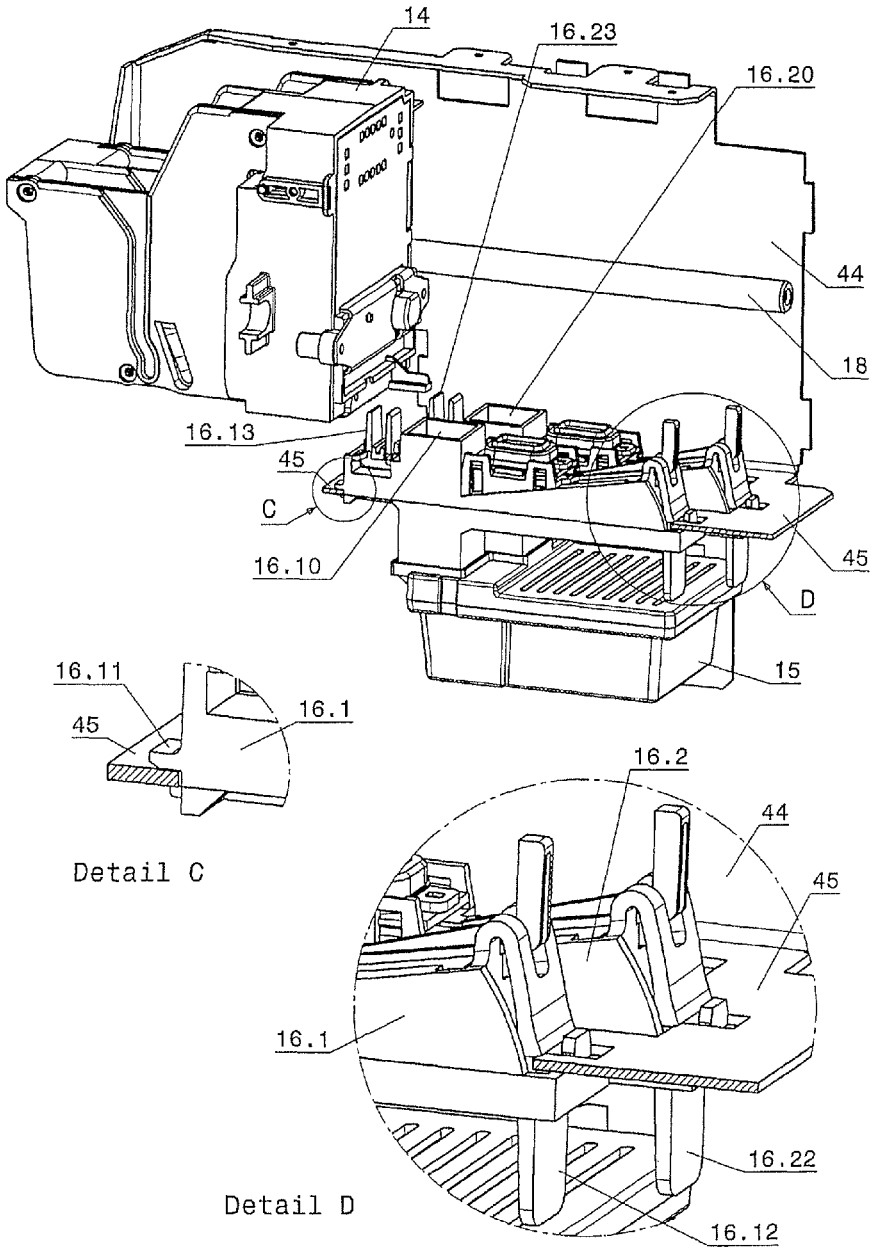
FIG. 12 is a perspective view of the print carriage at a frame side wall front the rear upper right, as well as the ink capture container and the arrangement of the service modules, as well as Details C and D of the mechanical connection of the latter with the frame base plate.

A perspective view of a print carriage 14 at a side frame wall 44 is shown from the rear upper right in FIG. 12. An ink capture container 15 and an arrangement of the service modules, as well as details C and D of the mechanism connection with the frame base plate 45, are likewise shown. The wiping lips 16.13, 16.23 extend in the direction of the print carriage 14, which is directed on a slide rail 18. The respective free-spraying shafts 16.10, 16.20 are arranged near the wiping lips 16.13, 16.23. The mechanism connection of the installation projection 16.11 with the frame base plate 45 for the service module 16.1 is shown enlarged in Detail C. Detail D shows the function of the resilient elastic detent lever 16.12, 16.22 of the service modules 16.1 and 16.2 after their engagement in the contour of the frame base plate 45, which is angled away from the side frame wall 44.

Although modifications and changes may be suggested by those skilled in the art, it is the intention of the inventor to embody within the patent warranted hereon all changes and modifications as reasonably and properly come within the scope of his contribution to the art.

We claim as our invention:

1. A franking machine comprising:

a security housing comprised of a joined upper housing shell and lower housing shell configured to form a tamper-proof enclosure within said security housing;

an ink jet printing device movable along a path within said tamper-proof enclosure in said security housing, said ink jet printing device being configured to eject ink to produce a printed imprint on a flat item movable through a transport path defined by an exterior configuration of said security housing;

said lower housing shell of said security housing having a base and interior walls proceeding upwardly from said base that define a non-secure volume within said security housing that has an exterior opening, and a removable cover that closes said exterior opening;

a plurality of assemblies contained in said non-secure volume of said lower housing shell at a location beneath a location at which said ink jet printing device ejects ink to produce said printed imprint, said assemblies in said non-secure volume being subject to contamination by said ink, and said assemblies comprising, in succession, an ink capture container, at least one service module, and an ink receptacle, said at least one service module comprising a shaft therein through which ink proceed from said ink capture container to said ink receptacle;

said assemblies being removably mounted in said non-secure volume and being accessible and removable through said opening when said cover is removed; and a hole provided in the security housing in to which a multifunction stylus is introduced to manually displaces said ink jet printing device within said tamper-proof enclosure.

2. A franking machine as claimed in claim 1 wherein one of said walls has a guide rail thereon, and wherein said ink capture container has an exterior edge with a guide groove therein that conforms to said guide rail, said ink capture container being slidable on said guide rail during insertion and removal thereof with respect to said volume.

3. A franking machine as claimed in claim 2 wherein said ink capture container comprises a funnel at a side thereof having a funnel opening aligned with said shaft of said at least one service module, with said ink proceeding from said shaft into said ink capture container via said funnel opening, and wherein said ink capture container comprises an elastically formable disk attached to an exterior thereof adjacent said guide groove and said funnel opening, said elastically deformable disk being located and configured to press said ink capture container against said shaft, in response to pressure exerted on said ink capture receptacle in said volume by said cover when said cover closes said opening, to form a sealed path between said shaft and said funnel opening.

4. A franking machine as claimed in claim 1 wherein said ink jet printing device comprises a movable print carriage having an ink receptacle cavity therein in which said ink receptacle is inserted, said print carriage being mechanically movable within said security housing to bring said print carriage, and said ink receptacle inserted therein, to said non-secure volume within said security housing, above said at least one service module and said ink capture container in said non-secure volume.

5. A franking machine as claimed in claim 1 comprising a frame base plate having an opening therein communicating with said non-secure volume in said lower housing shell, said opening in said frame base plate having a contour with a shape configured to a shape of said at least one service module.

6. A method for servicing a franking machine comprising a security housing comprised of a joined upper housing shell and lower housing shell configured to form a tamper-proof enclosure within said security housing, an ink jet printing device, comprising a removable ink cartridge, said ink jet printing device being movable along a path within said tamper-proof enclosure in said security housing, said ink jet printing device being configured to eject ink to produce a printed imprint on a flat item movable through a transport path defined by a box-shaped module removably mounted to an exterior of said security housing, said upper housing shell having a cartridge flap therein and said lower housing shell of said security housing having a base and interior walls proceeding upwardly from said base that define a non-secure volume within said security housing that has an exterior opening, and a removable cover that closes said exterior opening, a plurality of assemblies contained in said non-secure volume of said lower housing shell at a location beneath a printing station location at which said imprinting ink jet printing device ejects ink to produce said printed imprint, said assemblies in said non-secure volume being subject to contamination by said ink, and said assemblies comprising, in succession, an ink capture contain, at least one service module, and an ink receptacle, said at least one service module comprising a shaft therein through which ink proceed from said ink capture container to said ink receptacle, and said assemblies being removably mounted in said non-secure volume and being accessible and removable through said opening when said cover is removed, said method comprising:

causing said print carriage to move in a first direction in said secured housing to a first position opposite said cartridge flap, and removing said ink cartridges from the ink jet printing device;

closing said cartridge flap;

causing said print carriage to move in a second direction, opposite said first direction, to a second position in alignment with said non-secure volume;

removing said box-shaped module from the exterior of the security housing;

opening said cover of said non-secure volume and removing said assemblies from said non-secure volume; and servicing said assemblies outside of said non-secure volume to clean said assemblies from said ink contamination; and a hole provided in the security housing in to which a multifunction stylus is introduced to manually displaces said ink jet printing device within said tamper-proof enclosure.

7. A method as claimed in claim 6 comprising, after servicing said assemblies outside of said non-secure volume, re-installing said assemblies, in reverse order from the removal thereof, into said non-secure volume of said lower housing shell, and closing said cover of said opening.

8. A method as claimed in claim 6 comprising moving said ink carriage to said first position and to said second position in a power-supplied operating mode of said franking machine.

9. A method as claimed in claim 6 comprising:

before moving said printing carriage to said first position, disconnecting power from said franking machine;

inserting a rotatable tool into a tool-receiving opening in said security housing and mechanically engaging said tool with a mechanism in said security housing that causes movement of said print carriage, and manually rotating said tool from an exterior of said security housing to displace said print carriage to said first position and to said second position.

10. A method as claimed in claim 6 wherein said franking machine comprises a touch-screen display, and providing said tool with a tip having a first tip portion configured to mechanically engage said mechanism and with a second tip portion configured to serve as a stylus for manual interaction with said touch-screen display.

* * * * *